US005943922A

United States Patent [19]

Rolfe

[11] Patent Number: 5,943,922

[45] Date of Patent: Aug. 31, 1999

[54] CHUCK FOR THREADED FASTENERS

[76] Inventor: Henry E. Rolfe, 5172 Agerter Rd., Lima, Ohio 45805

[21] Appl. No.: 09/006,010

[22] Filed: Jan. 12, 1998

[51] Int. Cl.[6] ..... B25B 13/00

[52] U.S. Cl. ..... 81/124.2; 81/124.4

[58] Field of Search ..... 81/124.2, 901, 81/124.4, 119, 44

[56] References Cited

U.S. PATENT DOCUMENTS

| | | | |
|---|---|---|---|
| D. 160,267 | 9/1950 | McCammon et al. . | |
| D. 195,736 | 7/1963 | McManus . | |
| D. 274,881 | 7/1984 | Wilsey . | |
| 562,041 | 6/1896 | Seymour | 81/901 |
| 882,937 | 3/1908 | Fegley | 81/901 |
| 2,642,105 | 6/1953 | Alliano | 81/901 |
| 3,228,269 | 1/1966 | Heyer . | |
| 4,689,881 | 9/1987 | Fall | 81/901 |
| 4,724,731 | 2/1988 | Onofrio | 81/124.2 |
| 5,335,569 | 8/1994 | Rowley | 81/901 |
| 5,425,290 | 6/1995 | Fought et al. | 81/124.2 |
| 5,615,587 | 4/1997 | Foerster, Jr. | 81/124.2 |
| 5,791,208 | 8/1998 | Grubbs | 81/901 |
| 5,809,851 | 8/1998 | Thompson | 81/901 |

*Primary Examiner*—Timothy V. Eley
*Assistant Examiner*—Sinclair Skinner
*Attorney, Agent, or Firm*—Richard C. Litman

[57] ABSTRACT

A chuck tool usable to apply or remove threaded fasteners provided with an eye formation includes an elongated retainer sleeve having a cylindrical body presenting a forward cut-out adjacent a slotted base plate. During use of the chuck, the enlarged eye formation of a fastener is disposed within the sleeve cut-out with the fastener shank disposed through the base plate slot. In this position, the longitudinal axis of the fastener is aligned with the central axis of the sleeve as laterally spaced points on the fastener eye nest within two recesses communicating with the sleeve cut-out. Rotary displacement of the fastener is accomplished following the insertion of a bifurcated drive insert into the rear of the sleeve whereupon two forward fingers on the insert straddle a significant portion of the fastener eye, between the two points engaged within the sleeve recesses. The assembly is driven in either a clockwise or counterclockwise direction by the attachment of a suitable power mechanism to the rear of the drive insert.

8 Claims, 3 Drawing Sheets

CHUCK FOR THREADED FASTENERS

BACKGROUND OF THE INVENTION

This invention relates generally to chuck tools, and more particularly to an improved chuck especially constructed to accommodate threaded fasteners having a head or the like defining an eye formation, and which normally is not adaptable for direct engagement with conventional fastener drive elements.

1. Field of the Invention

The majority of threaded fasteners are adapted to be applied or removed from an associated material or work piece element by either a hand or power tool having a well known drive element adapted to mate with one or more conventional formations on the head of the fastener. In the case of fastener heads having a female Phillips or slotted/straight formation, it is known to provide drive bits having tips presenting a mating, male Phillips or straight blade configuration. In this manner, such drive bits may be utilized with either a hand or power mechanism to apply or remove these types of fasteners, be they screws or bolts.

A problem exists, however, when attempting to employ a tool to carry out the application or removal of specialized threaded fasteners such as screw-eye lag screws or bolts. Obviously, a slotted or Phillips drive bit would be of no help in engaging the substantially circular and planar configuration of the eye portion of such fasteners, nor can the eye formation be directly captured by the either the chuck of a drill device or the stub of an impact wrench.

Accordingly, it will be appreciated that a need exists for a tool that may be used with either a hand or power drill as well as an impact wrench in order to facilitate the ready application or removal of a threaded fastener having an eye formation on its head. Such a tool should comprise simple component(s) permitting of quick and easy attachment relative the intended fastener, and allow for the trans-mission of torque from the associated driving force, in a positive manner insuring of accurate, controlled assembly or disassembly of the fastener relative the material or article engaging its threads.

2. Description of the Related Art

An early example of a tool specifically adapted to facilitate the application and removal of screw eye fasteners will be found in U.S. Pat. No. 882,937 issued to Fegley on Mar. 24, 1908, and which includes a transversely slotted head engageable about a portion of the eye of a fastener. A pair of axially displaceable spring jaws, shiftable to bear upon the shank of the fastener, assist in retaining the fastener relative the tool while several other elements are called for to complete the tool assembly. This construction is quite unlike the present invention wherein no more than two very sturdy components are called for and which combine to provide enhanced stabilization of the eye of a fastener by engaging same along pairs of opposed faces such that positive driving forces are transmitted thereto.

U.S. Pat. No. 3,228,269 issued on Jan. 11, 1966, to Heyer relates to a driving tool for door stop elements, particularly those including a coiled spring section intermediate the shank and proposes an elongate body having a forked end and into which the door stop is laterally inserted with the threaded end thereof projecting through the forked end. In one embodiment, a wrench may be applied to the tool with rotary motion being transmitted by engagement of flats on the door stop by flat surfaces within the tool. The instant arrangement differs from the Heyer device in that laterally opposed surfaces of an eye formation on a threaded fastener are initially engaged by opposite recesses in an outer sleeve, following which a driver insert is slipped into the sleeve and includes transverse semicircular segments straddling and engaging opposite faces of the screw eye formation.

A two-part drive tool for lag fasteners is shown in U.S. Pat. No. 4,724,731 issued to Onofrio on Feb. 6, 1988, and depicts an inner drive element having a transverse slot into which the head and shank of a fastener is received while a plain sleeve is adapted to slide over the drive element and serves to strengthen the bifurcated portion thereof. The current improvement departs from the Onofrio device in that enlarged eye formation lag screws are being operated upon, rather than flattened eye lag screws and thus provision is made to accommodate the enlarged diameter thereof. Additionally, the present outer sleeve offers a slotted base plate to axially align the fastener shank, as well as opposed recesses stabilizing opposite edges of the enlarged fastener eye formation.

A tool for specifically driving eye screws will be found in U.S. Pat. No. 5,335,569 issued to Rowley on Aug. 9, 1994, and includes an elongate body provided with a circular recess accommodating screw eyes of varying diameters while the shank of the fastener reposes within an adjacent semicylindrical channel. An upstanding post within the recess fits within the fastener eye and its position may be adjustable. During operation of the tool, a slidable cover overlies the fastener eye within the recess to retain the fastener in place. Unlike the Rowley tool, the current apparatus is devoid of a multitude of relatively finely machined components and offers firm stabilization of an eye fastener by providing two sets of engaging surfaces respectively bearing upon two opposed surfaces of fastener eyes.

Various alternative tool socket formations are exhibited in U.S. Design Pat. Nos. Des. 160,267, Des. 195,736 and Des. 274,881 respectively issued to McCammon et al. on Sep. 26, 1950, McManus on Jul. 23, 1963, and Wilsey on Jul. 31, 1984. The tools of McCammon et al. and Wilsey appear to accommodate hexagonal work pieces of a specific size while the McManus device presents a transversely slotted member adapted to engage valves.

None of the above inventions and patents, taken either single or in any combination, is seen to even remotely suggest or describe the instant invention as claimed herein.

SUMMARY OF THE INVENTION

By the present invention, an improved tool is provided that offers quick attachment to and removal from, threaded fasteners having a head forming an eye configuration and whereby the fastener is quickly inserted or withdrawn from an associated structure by the application of any one of several types of powered driving tools such as drills and impact wrenches. A retainer sleeve is formed with a slotted foot or base plate and an adjacent cut-out area having opposed recesses or notches. In this manner, the eye formation of a threaded fastener may be inserted into the sleeve cut-out with opposite portions of the eye nested within the two sleeve notches and the fastener shank disposed within the slot in the base plate. Stabilization of the fastener eye is assured by sliding a bifurcated drive insert into the end of the sleeve, with the opposed legs or fingers of the insert capturing a substantial portion of two opposite surfaces of the fastener eye. The insert element additionally provides means whereby an appropriate powered driving machine may be connected to the tool.

Accordingly, one of the objects of the present invention is to provide an improved chuck tool for screw eye fasteners including an elongated retainer sleeve provided with a transverse slotted base plate adjacent a cut-out having a pair of opposed rearwardly directed recesses, and which cooperates with a drive insert slidable within the retainer sleeve and having an axially extending slot adapted to accommodate a substantial portion of a fastener's eye as positioned within the retainer sleeve recesses.

Another object of the present invention is to provide an improved chuck tool for screw eye fasteners including a retainer sleeve and mating drive insert respectively provided with recesses and bifurcated fingers, in turn adapted to engage and stabilize opposed pairs of surfaces of a fastener eye formation with these pairs of surfaces disposed normal to one another such that a positive capture of the eye formation is achieved when a fastener is engaged by the cooperating sleeve and insert.

A further object of the present invention is to provide an improved chuck tool for screw eye fasteners including a bifurcated drive insert axially slidable within a retainer sleeve provided with a cut-out to capture the eye formation of a fastener disposed within the cut-out and wherein the drive insert includes a female formation allowing for engagement of the chuck tool by a powered tool.

Still another object of the present invention is to provide an improved chuck tool for screw eye fasteners including a bifurcated drive insert axially slidable within a retainer sleeve provided with a cut-out to capture the eye formation of a fastener disposed within the cut-out and wherein the drive insert includes a male formation allowing for engagement of the chuck tool by a powered tool.

These and other objects of the present invention will become readily apparent upon further review of the following specification and appended claims.

BRIEF DESCRIPTION OF THE DRAWINGS

Similar reference characters designate corresponding parts throughout the several figures of the drawings.

Similar reference characters designate corresponding parts throughout the drawings.

DETAILED DESCRIPTION OF THE PREFERRED EMBODIMENTS

Figure 1:
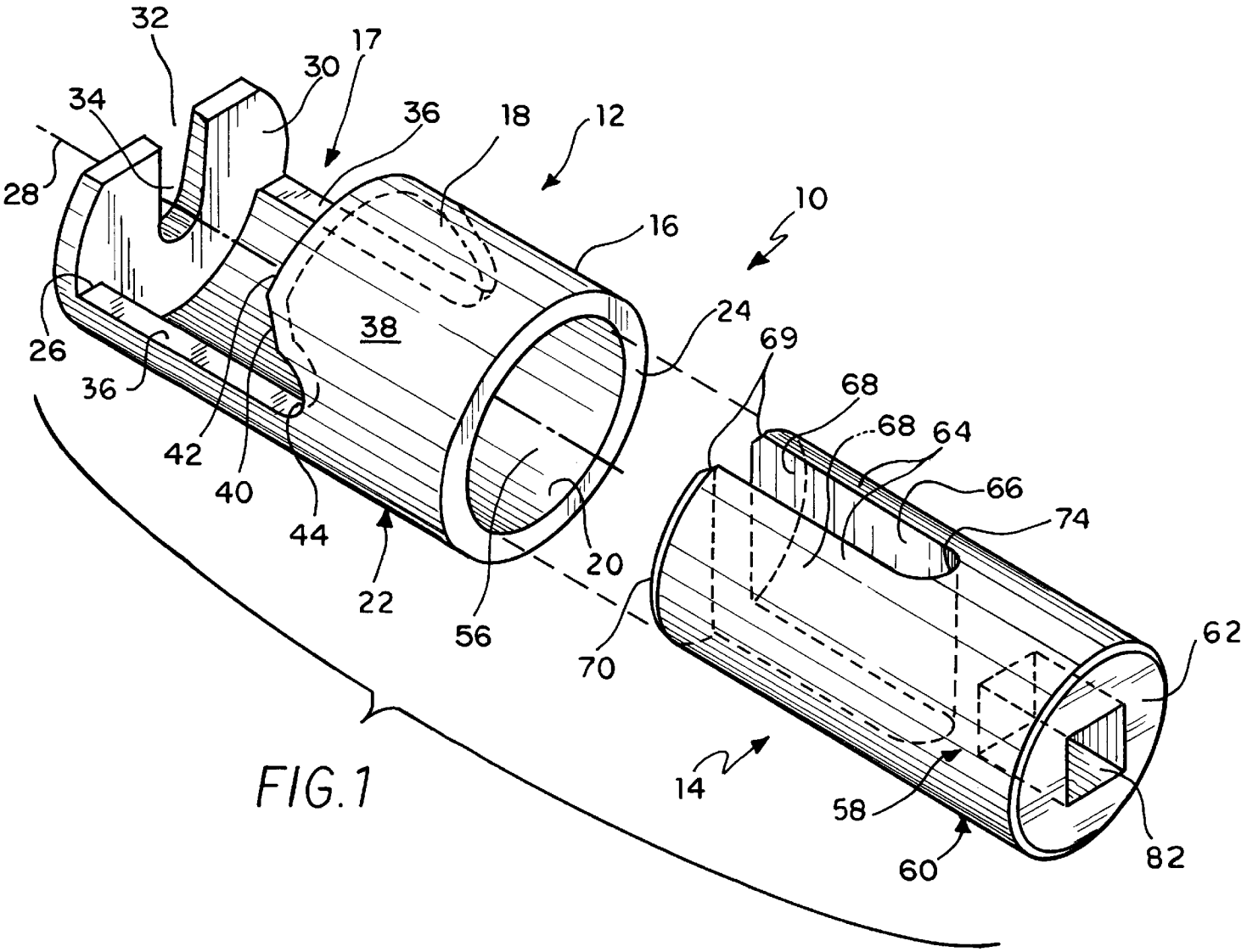
FIG. 1 is an exploded perspective view illustrating the two components of the invention.

Referring now to the drawings, particularly FIG. 1, the chuck tool 10 of the present invention will be seen to include a pair of components namely, a retainer sleeve 12 and cooperating drive insert 14. Both components will be understood to comprise rigid, unitary elements defining a cylindrical cross-section, and preferably are constructed of metal, with the outer diameter of the insert 14 presenting a close sliding fit within the inner diameter of the sleeve 12 for reasons which will become apparent hereinafter.

As the very function of the tool 10 is to provide ready means for positively retaining a screw eye fastener in a stabilized manner during its application to or removal from a foreign member, it will be appreciated that both the sleeve 12 and insert 14 are provided with specific construction insuring this objective.

The elongated cylindrical wall 16 of the sleeve 12 preferably includes smooth outer and inner surfaces 18, 20 respectively, with the lower segment 22 of the wall 16 extending longitudinally the full length of the sleeve, from its rear edge 24 to a forward edge 26. Affixed to this forward edge 26 and disposed normal to the central axis 28 of the sleeve, is a cradle comprising a foot or base plate 30 which will be seen to be provided with a slot 32. This slot 32 extends downwardly to a point just below a central axis of the sleeve, and terminates in an arcuate or semicircular surface 34. The sleeve wall 16 is provided with a cut-out 17 extending rearwardly from the forward edge 26 and foot 30 a substantial distance with its lower limit being defined by the top, horizontally disposed support surfaces 36—36 of the lower segment 22. For reasons which will be apparent shortly, the horizontal plane of these surfaces 36—36 is coincident with that of the bottom of the foot slot arcuate surface 34 and passes immediately below the central axis of the sleeve 38. The sleeve main body 38 or that portion of the sleeve wall comprising a full circle, will be seen to extend forwardly, from the rear edge 24 to the cut-out 17 and terminates in a front edge 40 projecting from a forward most upper portion 42 to two oppositely disposed rearwardly directed notches or recesses 44—44. These recesses will be seen to terminate in rearwardly directed semicircular surfaces, akin to the surface 34 of the foot slot 32.

From the above, it will be understood that the center of the radius forming both the foot slot arcuate surface 34 and the two cut-out recesses 44 will be disposed in a common plane substantially passing through the sleeve center axis 28. With this in mind, it will follow that as a screw eye lag fastener 46 is mounted within the sleeve as shown in FIG. 2, the center axis 48 of the fastener shank 50 will be substantially coincident with the sleeve center axis 28, as the shank reposes upon the foot slot arcuate surface 34 and two separate points 52—52 on the fastener eye 54 are seated within the cut-out recesses 44—44.

Figure 2:
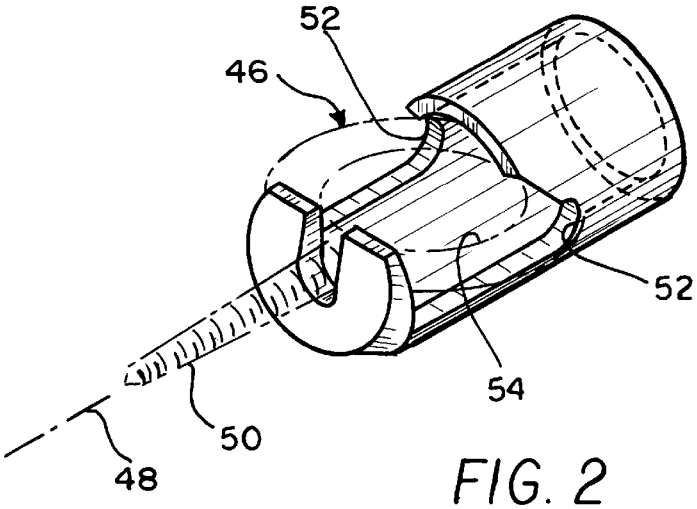
FIG. 2 is a top plan view with a screw eye fastener positioned within the sleeve element, as it appears just before introduction of the drive insert into the sleeve element.
Figure 3:
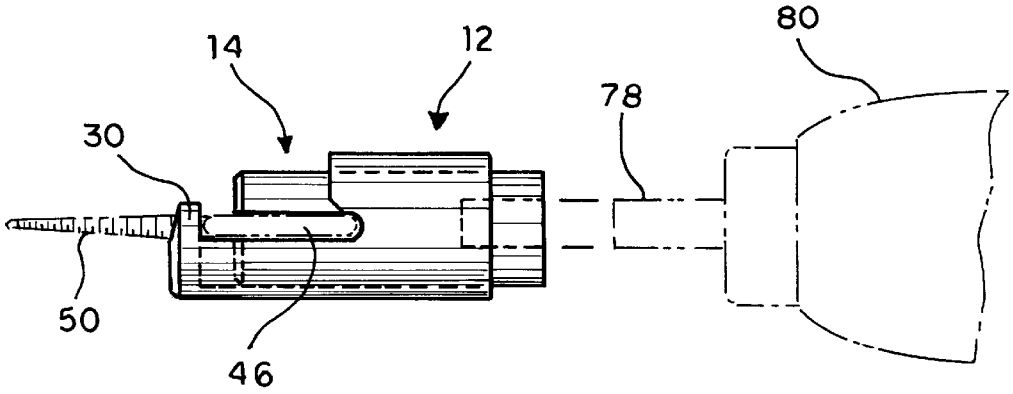
FIG. 3 is a side elevation view.

When the user of the chuck 10 has positioned a fastener 46 as per the above and as shown in FIG. 2, the assembly of the chuck tool 10 is completed by the introduction of the drive insert 14 into the cavity 56 of the sleeve 12. The construction of the insert 14 is shown most clearly in FIGS. 2 and 3 and wherein it will be seen that the integral formation of the insert includes a cylindrical body 58 having a rear section 60 bounded by a rear face 62 on the one end, and a pair of forwardly projecting fingers or segments 64—64 on the other end and between which is formed a central, transversely disposed slot 66. Thus, it will be noted that a bifurcated member is formed and wherein each of the two fingers 64 define a cross-section substantially similar to a semicircle.

The opposed, parallel faces 68—68 of the fingers 64—64 and which define the width of the slot 66, are spaced apart from one another substantially the same dimension as the circumferential extent of the sleeve recesses 44, and in turn it will be understood that this dimension is only slightly greater than the thickness of the stock making up the fastener eye formation 54. With this construction, it will be appreciated that with a screw eye 54 of fixed thickness nested within the two recesses 44—44 of the sleeve, the subsequent sliding of the drive insert 14 into the sleeve cavity 56 will permit the insert fingers 64—64 to straddle, in a close manner, the entire upper portion of the fastener eye 54, intermediate the two points 52—52 already engaged by the sleeve recesses.

Facilitating this assembly maneuver are bevels 69—69 provided on the finger end faces 70—70, adjacent the slot 66. This construction eases the angular alignment between the two components and passage of the finger end faces 70—70 forward of the eye formation. During this assembly of the two chuck components, the drive insert 14 is moved forward until the end faces 70—70 of the fingers 64—64 are juxtaposed the sleeve base plate 30, and at which point, the upper point or bight of the fastener eye 54 will be juxtaposed the rear end 74 of the drive insert slot.

Figure 4:
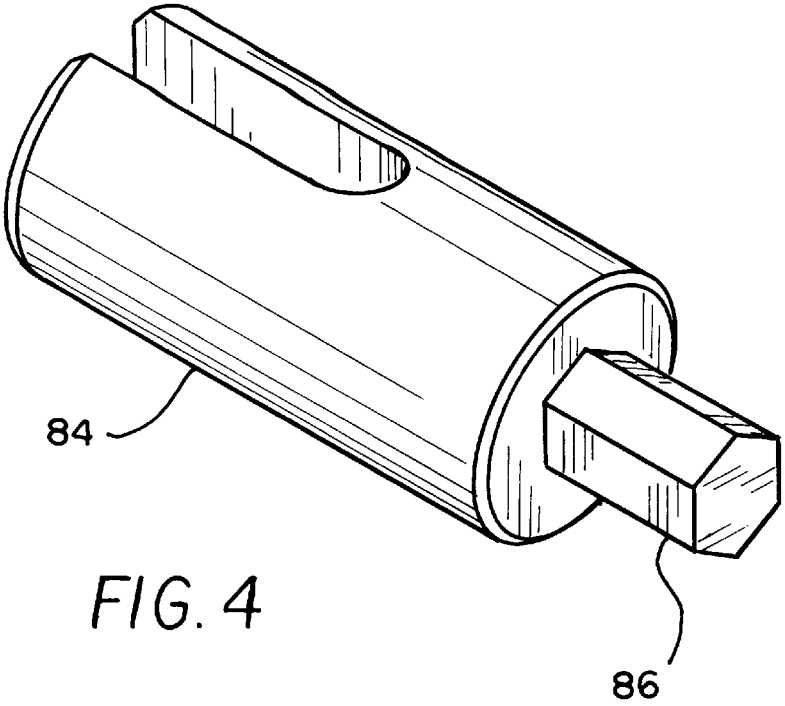
FIG. 4 is a rear perspective view depicting an alternative drive accommodation.

With the chuck and fastener assembled as described above, the fastener 46 is ready to be inserted or removed relative whatever workpiece 76 may be involved. Any suitable power mechanism may be employed to transmit rotary motion to the chuck tool such as an impact wrench or electric drill. An example of the former mechanism is shown in FIG. 4 and wherein the square driving stub 78 of a pneumatic impact wrench 80 is inserted within an attachment element comprising a mating square recess 82 formed in the rear face 62 of the drive insert 14. In this manner, rotary force delivered by the power mechanism stub 78 is transmitted to the chuck drive insert 14 which in turn conveys this rotary displacement to the insert fingers 64—64. Since these fingers are closely embracing two opposite surfaces of the fastener eye 54 for a significant distance between the two recesses 44—44 of the sleeve member 12, it will be appreciated that a substantially stabilized engagement exists between the chuck tool 10 and the fastener 46 so that a positive, controlled application or removal of the fastener may be accomplished as the power mechanism 80 is operated in either the forward or reverse direction.

The embodiment shown in FIG. 4 represents an alternative drive insert 84 functioning in exactly the same manner relative its engagement within the drive sleeve 12 and with a fastener eye 54. The distinction in this variant is that instead of providing a square socket or recess in the rear face 62 of the insert as an attachment element, a shank 86 projects rearwardly therefrom and is engageable by an electric drill chuck or the like (not shown). The shank 86 may provide a circular, hexagonal or other exterior surface intended to be engaged by a power mechanism other than an impact mechanism.

Figure 5:
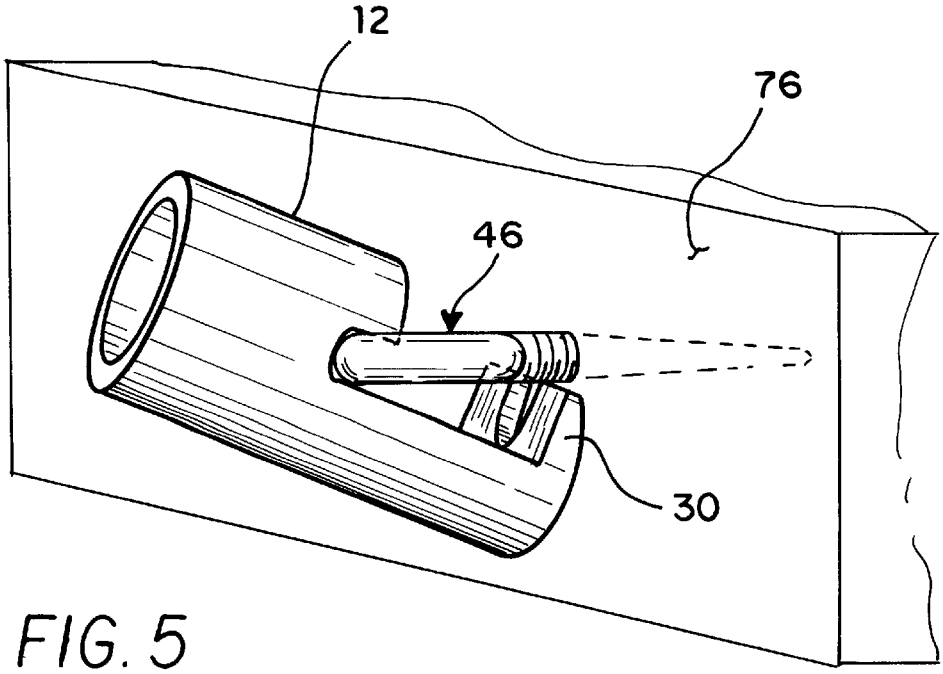
FIG. 5 is a side perspective view illustrating the attachment or removal of the retainer sleeve relative a screw eye fastener.

FIG. 5 illustrates the relationship between the eye of a threaded fastener and the retainer sleeve 12 as these two elements would appear either upon removing the sleeve from an installed fastener or, during assembly of the two elements prior to removal of a fastener from a workpiece.

From the above, it will be seen that an improved chuck device is presented for the ready application or removal of a screw eye fastener and wherein an outer retainer sleeve axially stabilizes an inserted fastener eye while a drive insert, when slipped into the sleeve, captively engages opposite surfaces of a significant portion of the fastener eye to transmit rotary displacement of the drive insert to the aligned fastener.

It will be understood that the present invention is not limited to the embodiments described hereinabove, but encompasses any and all embodiments within the scope of the appended claims.

I claim:

1. A chuck tool for engagement with the eye formation of a threaded fastener having a shank comprising:

a retainer sleeve having a central longitudinal axis, a wall provided with a central cavity, and a cut-out in said wall communicating with a pair of recesses in said wall, said sleeve including a cradle adjacent said wall cut-out; whereby said cradle is adapted to support the shank of a threaded fastener as the eye formation thereof is disposed within said sleeve cut-out with two spaced apart points on the eye formation engaging said pair of wall recesses; and a drive insert having a pair of forwardly directed fingers spaced apart to provide an intermediate slot;

said drive insert fingers insertable within said sleeve central cavity with said fingers spaced from one another an amount selected to insure a close fit when straddling the eye formation of a fastener disposed intermediate said sleeve wall recesses, each of said drive insert fingers defines a generally semicircular cross-section and includes an end face having a bevel adjacent said intermediate slot; and an attachment element on said drive insert adapted to be engaged by a power mechanism to impart rotary displacement of said drive insert together with a threaded fastener having an eye formation engaged by said drive insert and retainer sleeve wall recesses.

2. A chuck tool according to claim 1, wherein:

said retainer sleeve wall is cylindrical; and said drive insert includes a body section having a cylindrical configuration presenting a close mating fit when disposed within said retainer sleeve central cavity.

3. A chuck tool according to claim 1, wherein:

said retainer sleeve cradle includes a base plate disposed transversely of the central longitudinal axis of said sleeve; and said cradle has a slot intersecting with the central longitudinal axis of said sleeve.

4. A chuck tool according to claim 1, wherein:

said retainer sleeve includes a rearward cylindrical main body and a forward substantially semicircular lower segment; and said lower segment has a pair of opposite longitudinally extending support surfaces disposed in a horizontal plane adjacent the central longitudinal axis of said sleeve.

5. A chuck tool according to claim 1, wherein:

said drive insert includes a rear face; and said attachment element includes a socket formation within said rear face.

6. A chuck tool according to claim 1, wherein:

said drive insert includes a rear face; and said attachment element includes an elongated shank projecting rearwardly from said rear face.

7. A chuck tool according to claim 1, wherein:

said drive insert includes a rear face; and said attachment element includes a socket formation within said rear face.

8. A chuck tool according to claim 1, wherein:

said drive insert includes a rear face; and said attachment element includes an elongated shank projecting rearwardly from said rear face.

* * * * *